US011686135B1

(12) United States Patent
Smith

(10) Patent No.: US 11,686,135 B1
(45) Date of Patent: Jun. 27, 2023

(54) PRE-HUNG DOOR AND CASING RETENTION DEVICE

(71) Applicant: B. Jack Smith, Bixby, OK (US)

(72) Inventor: B. Jack Smith, Bixby, OK (US)

( * ) Notice: Subject to any disclaimer, the term of this patent is extended or adjusted under 35 U.S.C. 154(b) by 112 days.

(21) Appl. No.: 17/344,408

(22) Filed: Jun. 10, 2021

Related U.S. Application Data

(60) Provisional application No. 63/042,607, filed on Jun. 23, 2020.

(51) Int. Cl.
*E05C 19/18* (2006.01)

(52) U.S. Cl.
CPC ..... *E05C 19/188* (2013.01)

(58) Field of Classification Search
CPC . Y10T 292/34; Y10T 292/37; Y10T 292/379; Y10T 292/42; Y10T 292/432; Y10T 292/438; Y10T 292/65; Y10T 292/67; E05C 19/188; E05C 19/18; E05C 19/184; E05B 63/0034; E05B 63/0043; E05B 63/0052; E05B 17/0012; Y10S 292/30; Y10S 292/38; Y10S 292/64; F16B 21/073; F16B 21/078
USPC ..... 49/380; 206/325
See application file for complete search history.

(56) References Cited

U.S. PATENT DOCUMENTS 3,125,366 A 3/1964 Cetrone et al.
3,593,458 A 7/1971 Wahfield
4,109,948 A 8/1978 Potter et al.
D319,007 S 8/1991 Rogers et al.
5,159,782 A 11/1992 Sales
5,562,315 A 10/1996 Sales
5,722,203 A * 3/1998 Staples ..... E06B 7/00 49/380
5,787,639 A * 8/1998 Lamore, Jr. ..... E05B 17/0012 49/380
6,170,198 B1 1/2001 Staples et al.
6,345,946 B1 * 2/2002 Mainini ..... F16B 21/086 411/339
6,357,181 B1 * 3/2002 Triemstra ..... E06B 7/28 206/325
6,485,069 B1 * 11/2002 Anderson ..... E05B 17/0012 292/175
6,874,827 B1 4/2005 Dodson
7,121,045 B2 10/2006 Massey et al.
(Continued)

FOREIGN PATENT DOCUMENTS

WO WO-2008072974 A1 * 6/2008 ..... E05B 1/00

*Primary Examiner* — Kristina R Fulton
*Assistant Examiner* — Steven A Tullia
(74) *Attorney, Agent, or Firm* — Head, Johnson, Kachigian & Wilkinson, PC

(57) ABSTRACT

A pre-hung door and casing retention device and a method of latching and unlatching a pre-hung door and casing. The door includes a tubular body configured to be receivable in a door lock cylinder opening and a door latch opening. A male portion has an extending post with a plurality of teeth extending from at least one side of said post, the male portion receivable in a latch bolt opening and the door latch opening. An elongated engagement portion has a first end fastened in the tubular body, an opposed second end extending from the tubular portion and a protrusion engaging teeth on the male portion when inserted into the tubular portion and wherein the protrusion is disengaged from the teeth when a withdrawal force is exerted on the engagement portion.

10 Claims, 8 Drawing Sheets

(56) References Cited

U.S. PATENT DOCUMENTS

| | | | | |
|---|---|---|---|---|
| 7,213,371 | B1 | 5/2007 | Vanderpan | |
| 8,052,178 | B2 | 11/2011 | MacDonald et al. | |
| 8,245,448 | B2 | 8/2012 | Crane et al. | |
| 9,669,770 | B1 * | 6/2017 | Schlaupitz | F16B 21/073 |
| 9,714,527 | B2 * | 7/2017 | Winkler | E05B 63/0034 |
| 10,072,455 | B2 | 9/2018 | Smith | |
| 10,294,716 | B2 * | 5/2019 | Ege | E06B 7/28 |
| 10,851,583 | B2 * | 12/2020 | Ezra | E06B 7/28 |
| 2004/0201228 | A1 | 10/2004 | L'Heureux et al. | |
| 2005/0284091 | A1 * | 12/2005 | Sales | E06B 7/28<br>52/745.15 |
| 2008/0023969 | A1 * | 1/2008 | MacDonald | E05C 1/04<br>292/145 |
| 2010/0166524 | A1 * | 7/2010 | Crane | E05B 17/0012<br>411/103 |
| 2014/0306461 | A1 | 10/2014 | Luizzi et al. | |
| 2017/0009499 | A1 * | 1/2017 | Smith | E06B 3/00 |

* cited by examiner

PRE-HUNG DOOR AND CASING RETENTION DEVICE

1. CROSS-REFERENCE TO RELATED APPLICATIONS

This application is based on and claims priority to U.S. Provisional Patent Application Ser. No. 63/042,607, filed Jun. 23, 2020, which is incorporated herein in its entirety by reference.

2. FIELD OF THE INVENTION

The present invention relates to a temporary door latch device for a pre-hung door and casing, for retaining a door and casing in alignment during transportation and shipping of the pre-hung door and casing unit, and relates to a method to latch and unlatch the temporary door latch device.

3. PRIOR ART

In the past, the standard way to install a door in either new or remodeled construction was to prepare and construct a doorway casing and jamb. The casing and jamb would have to be plumb and square. A door would then be sized and fitted to the opening constructed, recesses would be made for hinges, and the hinges would be attached to both the door casing and the door. An opening would be drilled or cut from one side of the door to the other for a door cylinder opening (or knob hole) and another opening would be drilled or cut from an edge of the door to the door cylinder opening for a door latch opening (or strike hole). Finally, the door lock hardware would be installed.

Increasingly, pre-hung door units are utilized which are already built and assembled having a door casing with the door fitted thereto already assembled with hinges. A pre-drilled or pre-cut hole or opening is already supplied for a door cylinder and an opening from an edge of the door into the door cylinder opening is already made for a latch bolt opening. An aligned opening is also made through the door casing adjacent the latch bolt opening.

Pre-hung door shops, millwork shops, and certain manufacturers supply these pre-hung door units with casing or jambs. The door jambs include two vertical, opposed side jambs and a header fitted across the top of the side jambs. A temporary strip or a permanent seal may optionally also be fastened across the bottom of the jambs. The door and casing unit is prepared for installation of the handle and lock set but is not fitted with the knobs, striker plates, and latches since these are selected by the building owner or home owner and then installed later on site.

The door and casing assembly requires a fastener or fasteners to hold the door in a closed position relative to the door jamb during transportation and shipment to a worksite. Finally, it will be appreciated that any fastener or fasteners must be removed prior to installation of the door hardware.

Straps or other packaging have been used in the past to hold the door and the door casing together. Alternatively, a nail will be driven through the casing into the edge of door to securely hold the door during shipping. The nail or nails deface the edge of the door and must be removed prior to installation.

Various other proposals have been made in the past. For example, Crane et al. (U.S. Pat. No. 8,245,448) discloses a door plug 40 for a pre-hung door having a bolt member 42 and a threaded fastener 44. The bolt member includes a collar 46 and a cylindrical shaft 48. FIG. 6A shows an alternate fastener 244' with resilient pawls 270B on extending tip members 271B. The fastener is removed by counterclockwise rotation of the fastener 244'. It is necessary to thread the zo fastener into the bore and, likewise, unthread the fastener for removal. The fastener does not appear to be accessible once the casing has been placed over the door jambs.

MacDonald et al. (U.S. Pat. No. 8,052,178) discloses a temporary door lock assembly 20 having a rosette 34 with a base plate 36 which mates with an inside plate 112. A barrel 62 has a hollow interior to accept the bolt 58 telescopingly connected. A locking arm 84 moves the bolt between an extended and retracted position. The assembly 20 would be required to be removed prior to painting or staining of the door.

Lamore, Jr. (U.S. Pat. No. 5,787,639) discloses a door hanger bolt assembly with a stud element 19 received in a bolt 16. A shim 16 is placed between the door and the frame. A cycloid wedge 37 is inserted into the lockset hole and the stud with barbs 20 is driven into the door edge. The stud with barbs 20 would not appear to be accessible once any casing or frame has covered the jambs.

Staples et al. (U.S. Pat. No. 6,170,198) discloses a two-piece assembly having a first portion received in the door cylinder opening having a threaded shaft and a second portion having an internally threaded opening.

All of the prior art devices must be removed before the door and casing are installed in the door opening.

Applicant's prior patent, Smith (U.S. Pat. No. 10,072,455), discloses a temporary door latch device which is engaged in one orientation and disengaged in another orientation.

Notwithstanding the foregoing, it would be desirable to provide a temporary door latch device for a pre-hung door and casing which can be installed by simply inserting the device with no tools, and no damage to either the door or the casing.

It would also be desirable to provide a temporary door latch device for a pre-hung door and casing having interlocking components that are self-aligning.

It would also be desirable to provide a temporary door and latch device for a pre-hung door and casing that may be removed after the door and casing have been installed in the door opening.

SUMMARY OF THE INVENTION

The present invention is directed to a pre-hung door and casing retention device for a door having a door lock cylinder opening and a door latch opening and wherein a casing has a latch bolt opening. The present invention is also directed to a temporary door latch device for retaining a door and casing in alignment during transportation and shipping. The present invention is also directed to a method to latch and unlatch the temporary door latch device.

The retention device includes a tubular body which is configured to be receivable in the door lock cylinder opening and the door latch opening. The tubular body has a first open end, an opposed second open end, and a passageway therebetween. The second end may optionally terminate in an arcuate end which mates with the door lock cylinder opening when installed.

The retention device also includes a male portion receivable in the latch bolt opening and the door latch opening. The male portion has an extending post with a plurality of teeth extending from at least one side of the post. The post extends from a base larger in diameter than the latch bolt opening so that the base acts as a stop when the male portion is inserted into the latch bolt opening.

An elongated engagement portion has a first end fastened in the tubular body and an opposed second end extending from the tubular body. A protrusion between the first end and the second end engages the teeth on the male portion when in a locked position when the post of the male portion is inserted into the tubular portion. The protrusion is disengaged from the teeth on the male portion when a withdrawal force is exerted on the elongated engagement portion.

DETAILED DESCRIPTION OF THE PREFERRED EMBODIMENTS

The embodiments discussed herein are merely illustrative of specific manners in which to make and use the invention and are not to be interpreted as limiting the scope.

While the invention has been described with a certain degree of particularity, it is to be noted that many modifications may be made in the details of the invention's construction and the arrangement of its components without departing from the scope of this disclosure. It is understood that the invention is not limited to the embodiments set forth herein for purposes of exemplification.

Figure 1:
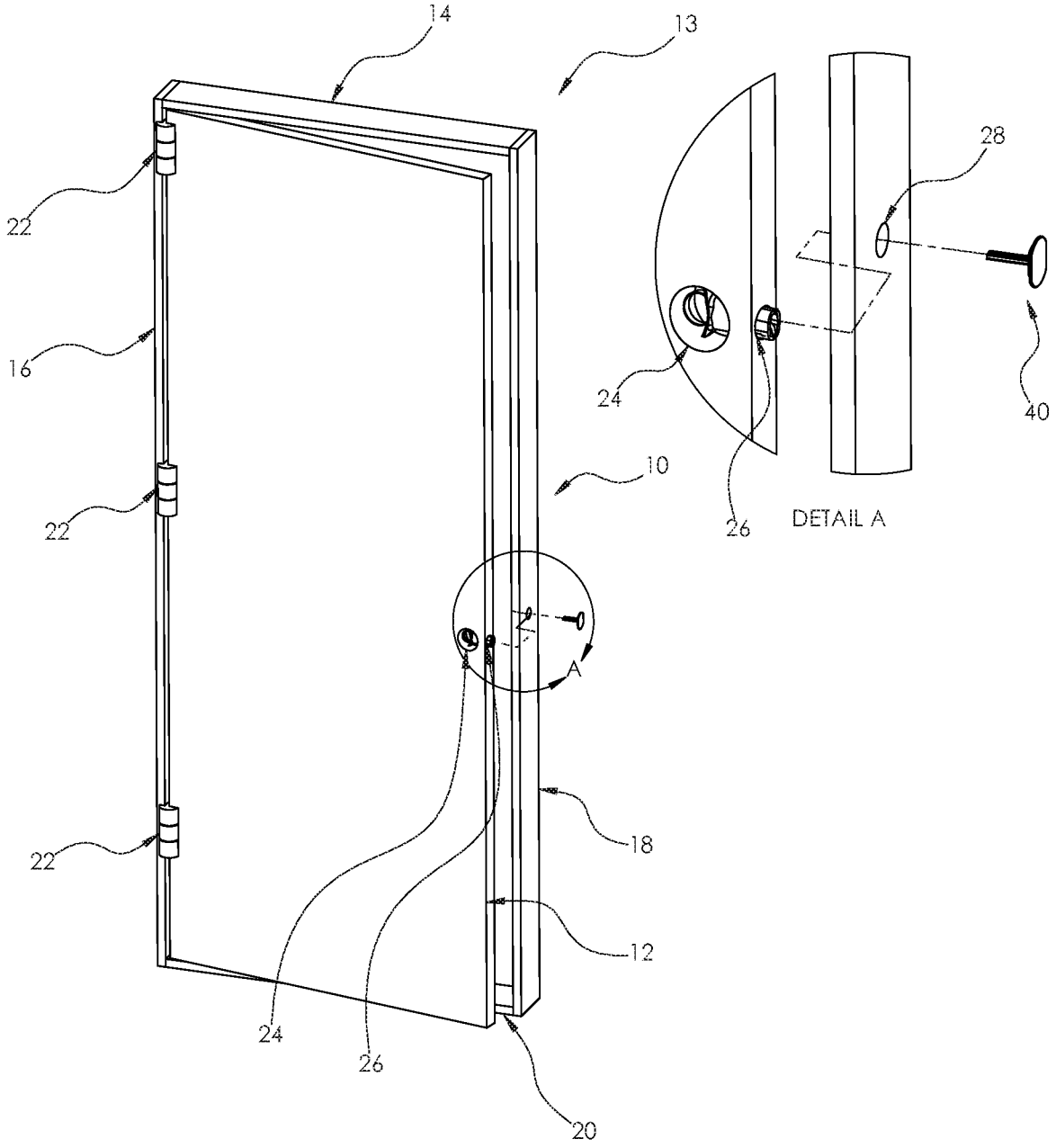
FIG. 1 is a perspective view of one preferred embodiment of a pre-hung door and casing with the door slightly open for ease of viewing and a temporary retention device for retaining a pre-hung door and casing during transportation and shipping constructed in accordance with the present invention.

Referring to the drawings in detail, FIG. 1 illustrates a perspective view of a pre-hung door unit 10 consisting of a door 12 and a casing 13 with the door 12 slightly open for ease of viewing. The casing 13 has a top 14 and extending opposed side jambs 16 and 18 along with an optional bottom or base 20. One side edge of the door 12 includes hinges 22 at a location near one edge of the door 12. Opposite the hinges 22, set back from the opposed edge of the door 12, is a pre-drilled cylindrical opening pre-drilled or configured for a door lock cylinder opening 24, which passes through the door 12.

The door 12 moves on the hinges 22 between an open and a closed position. In FIG. 1, the door 12 is shown slightly or partially open for ease of viewing. Once the door 12 has been moved to the closed position, a retention device 40 of the present invention may be used to hold the door 12 and the casing 13 together.

The cylindrical door lock opening 24 in the door 12 is in communication with a pre-drilled door latch opening 26 in the door 12 which passes from the edge of the door 12 into the door lock cylinder opening 24. In addition, a pre-drilled latch bolt opening 28 passes through the side jamb 18 and is aligned with the door latch opening 26 when the door 12 is closed.

The retention device 40 will be utilized to retain the door to the casing in the closed position. Once the pre-assembled door and the accompanying casing have been transported to the work site and installed, the retention device 40 of the present invention will be removed and a cylindrical lock and hardware (not shown in FIG. 1) will be installed in order to complete the installation construction.

Figure 2:
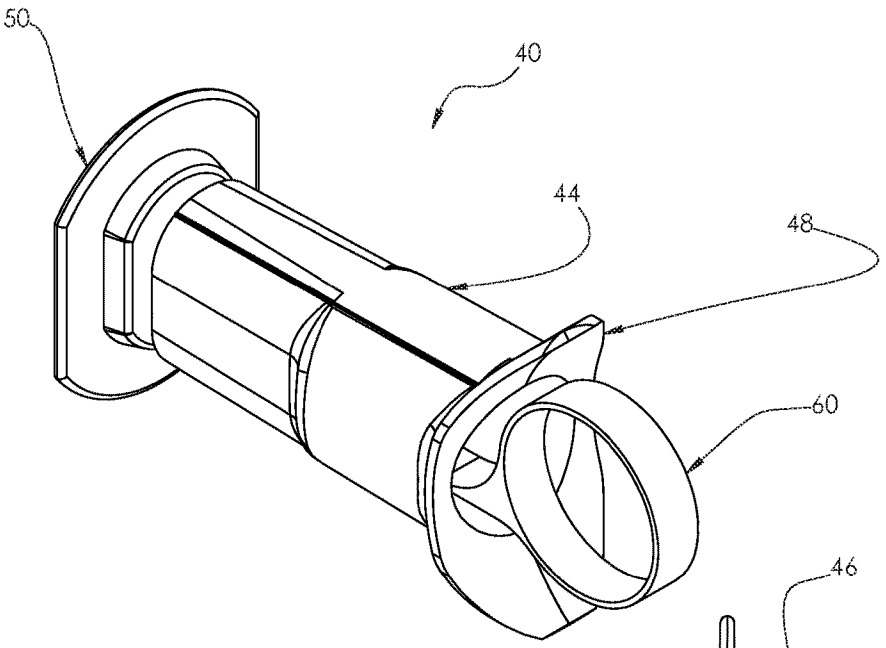
FIG. 2 illustrates a perspective view.
Figure 3:
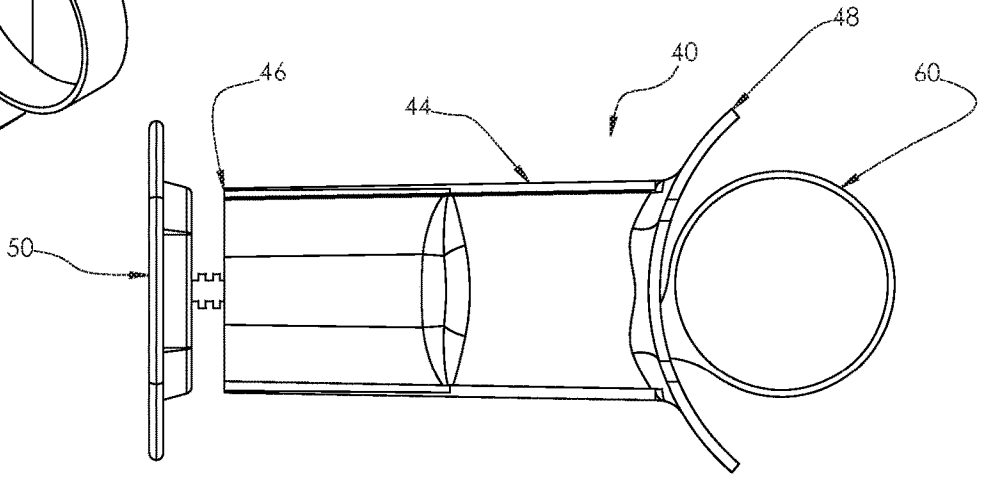
FIG. 3 illustrates a side view.
Figure 4:
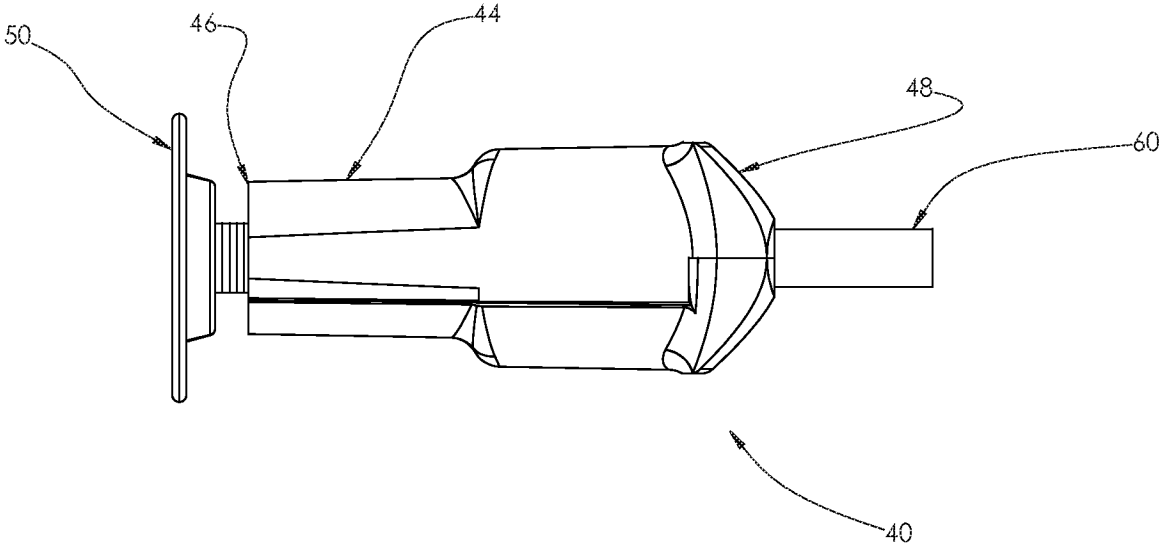
FIG. 4 illustrates a top view of the retention device shown in FIG. 1 apart from the door and casing.

FIG. 2 illustrates a perspective view, FIG. 3 illustrates a side view, and FIG. 4 illustrates a top view of the retention device 40 apart from the door unit 10. The retention device 40 includes a tubular body 44 which is configured to be received in the door lock cylinder opening 24. Accordingly, the external diameter of the tubular body 44 is slightly less than the diameter of the door lock cylindrical opening. The tubular body 44 has a first open end 46, an opposed second end, and a passageway therebetween. The tubular body 44 has an outside diameter slightly less than the diameter of the door latch opening 26. The second end may optionally terminate in an arcuate end 48 having a diameter larger than the diameter of the door lock cylinder which arcuate end 48 mates with the door lock cylinder opening 24 when installed. The arcuate end 48 also acts as a stop.

The retention device 40 also includes a male portion 50 receivable in the latch bolt opening 28 and the door latch opening 26, which will be described in detail.

The retention device 40 also includes an elongated engagement portion 60 received in the tubular body 44, through the arcuate end 48, which will be described in detail.

Figure 5:
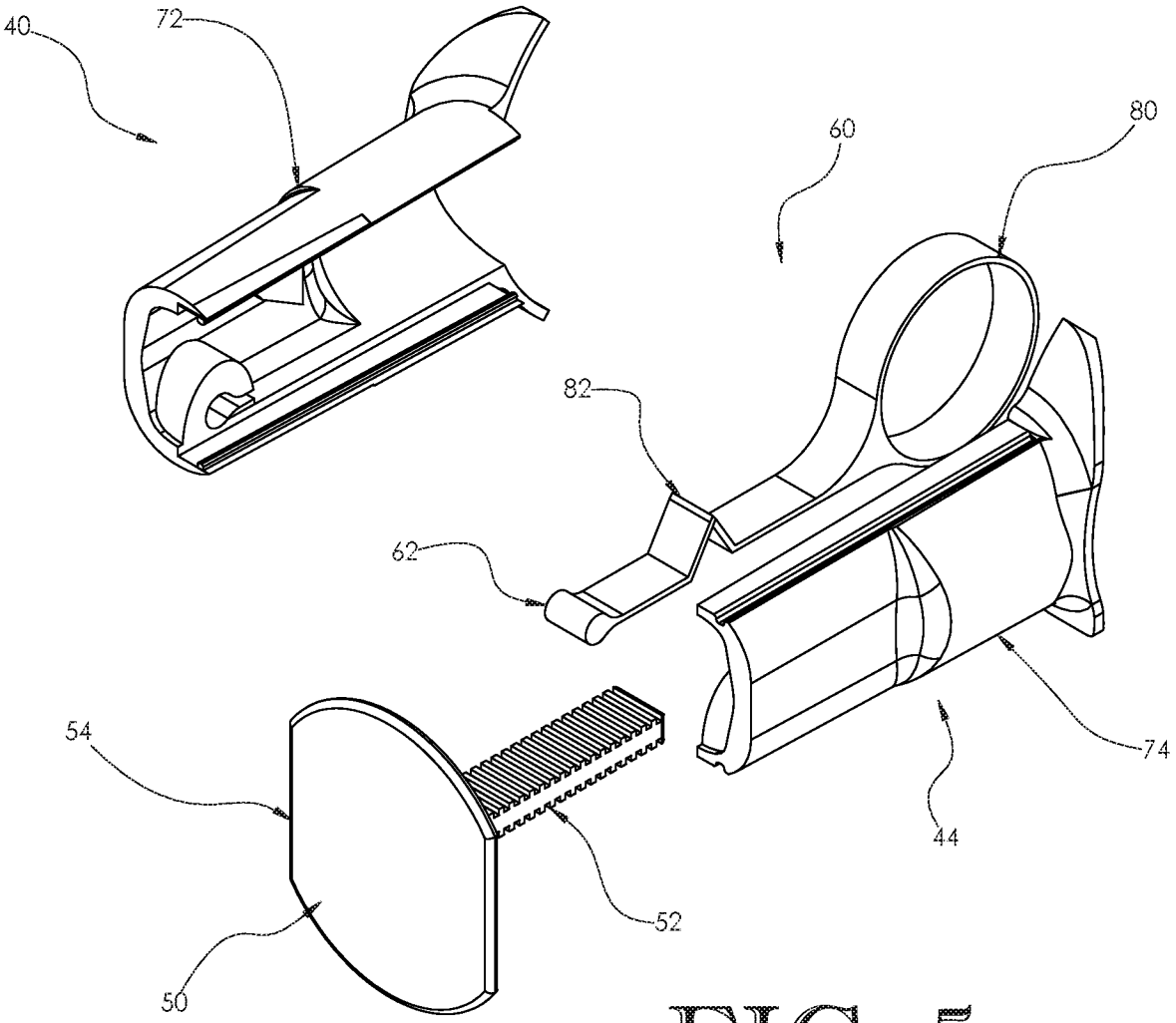
FIG. 5 illustrates an exploded view of the retention device.

FIG. 5 is an exploded view of the retention device 40 apart from the door unit 10. The male portion 50 has an extending planar post 52 with a plurality of teeth on at least one side of the post. In a preferred embodiment, the planar post 52 has a plurality of teeth on opposed sides of the post 52. The post 52 extends from a base 54 larger in diameter than the latch bolt opening 28 (not seen in FIG. 5). Accordingly, the base 54 acts as a stop when the male portion 50 is inserted into the latch bolt opening 28.

In one non-limiting embodiment, the tubular body 44 may be composed of two similar body halves 72 and 74 which are joined together to form the tubular body 44. The body halves 72 and 74 include recesses 76 and 78, respectively, which join together to form a receptacle. The body halves 72 and 74 may be snap fit or otherwise held together. It will be appreciated that the tubular body 44 may be comprised of a single or multiple parts within the spirit of the invention.

Figure 6:
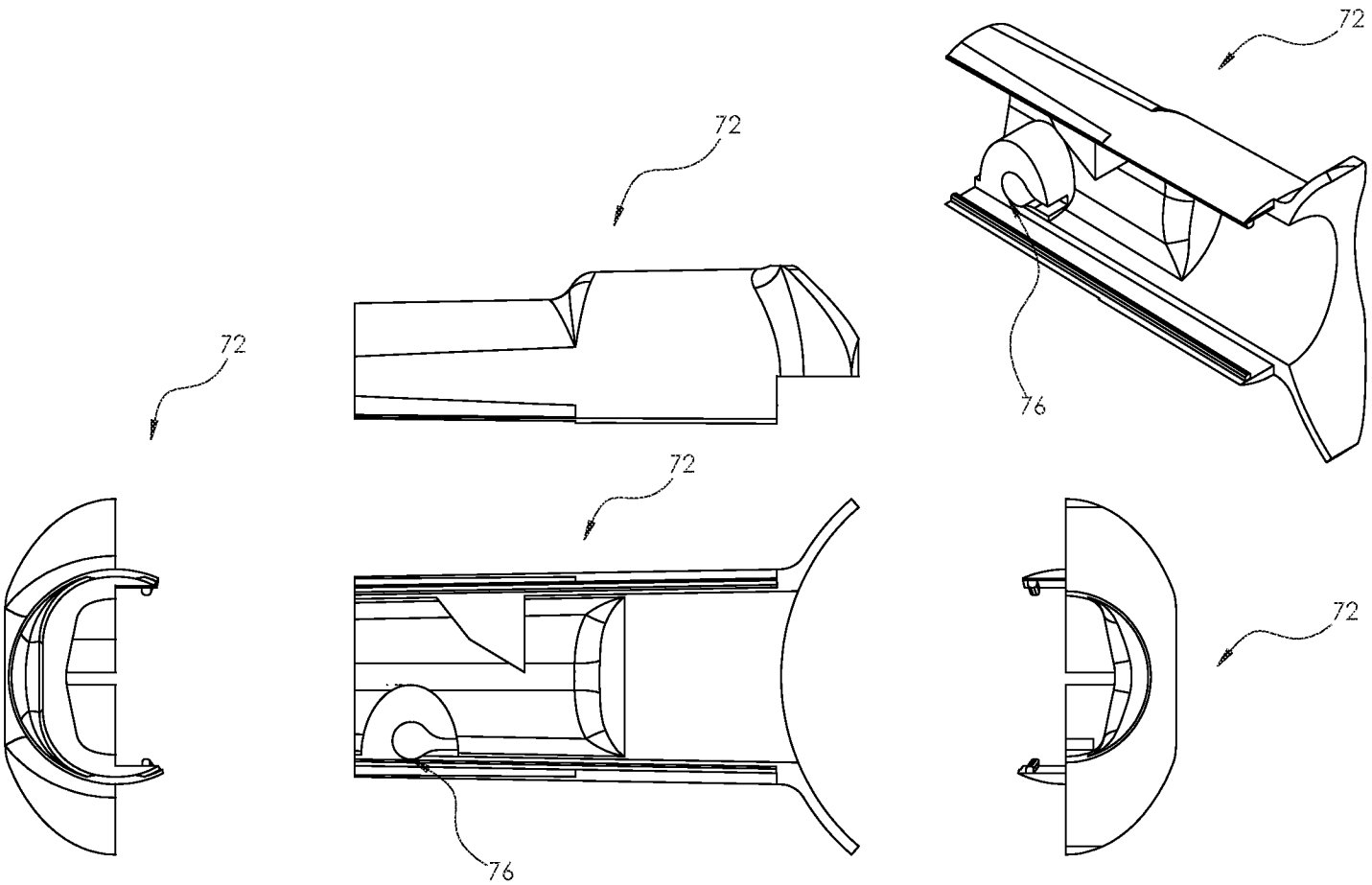
FIGS. 6 and 7 each illustrate alternate views of body halves which together form a tubular body of the retention device.
Figure 7:
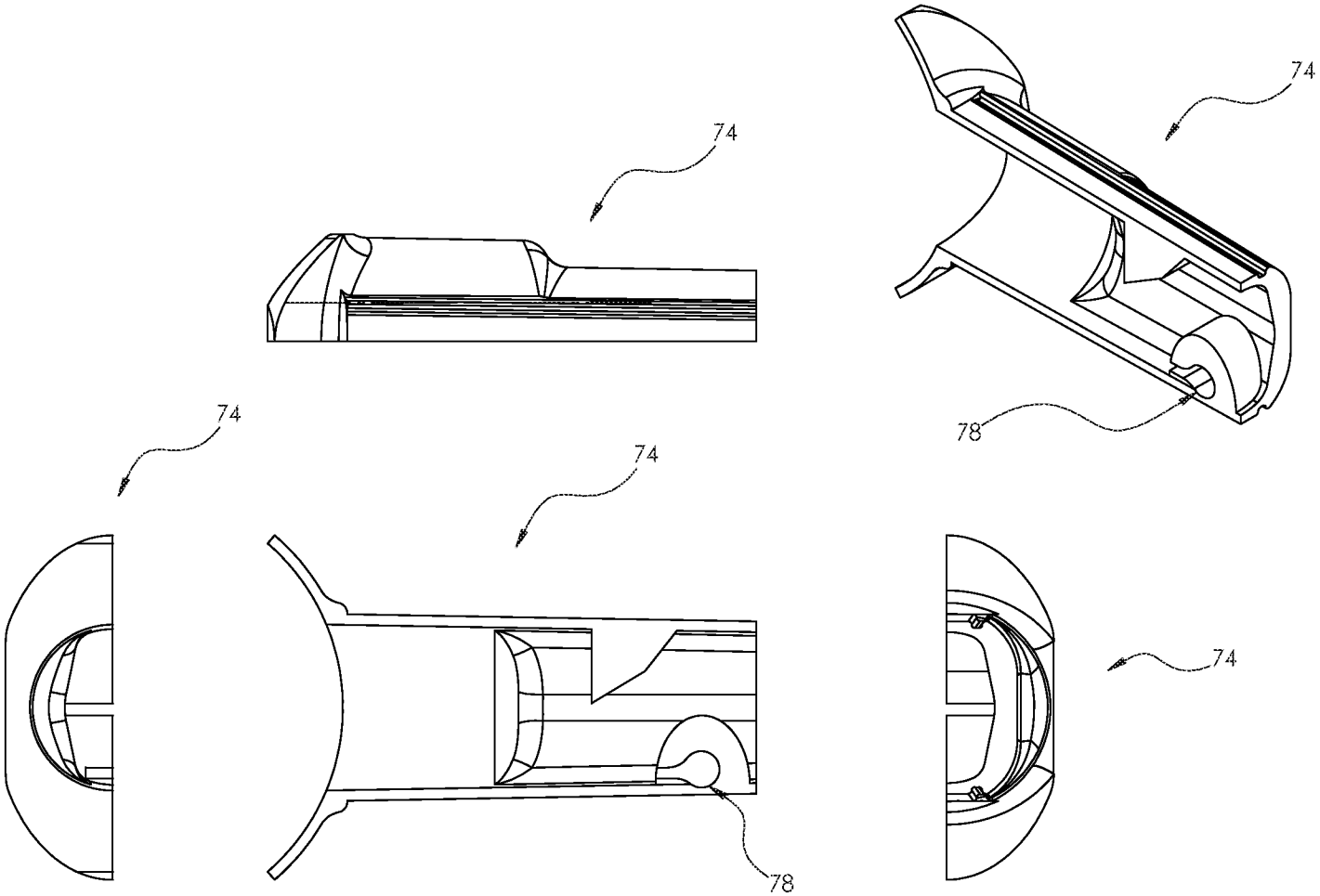

FIGS. 6 and 7 illustrate alternate views of the two body halves 72 and 74, respectively, of the tubular body 44. The halves 72 and 74 join together so that a passageway extends through the tubular body 44.

Figure 8:
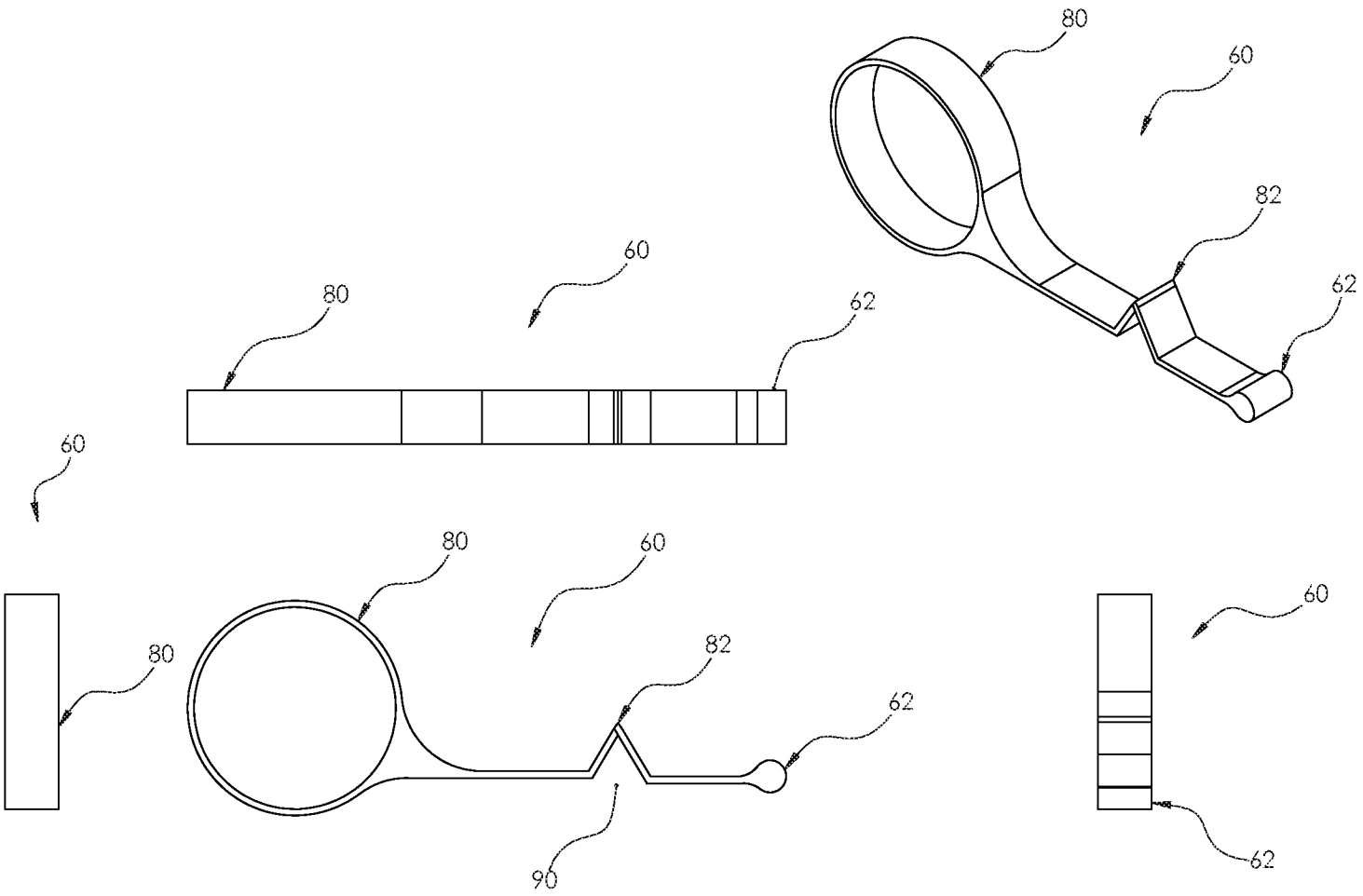
FIG. 8 illustrates alternate views of an elongated engagement portion of the retention device.
Figure 9:
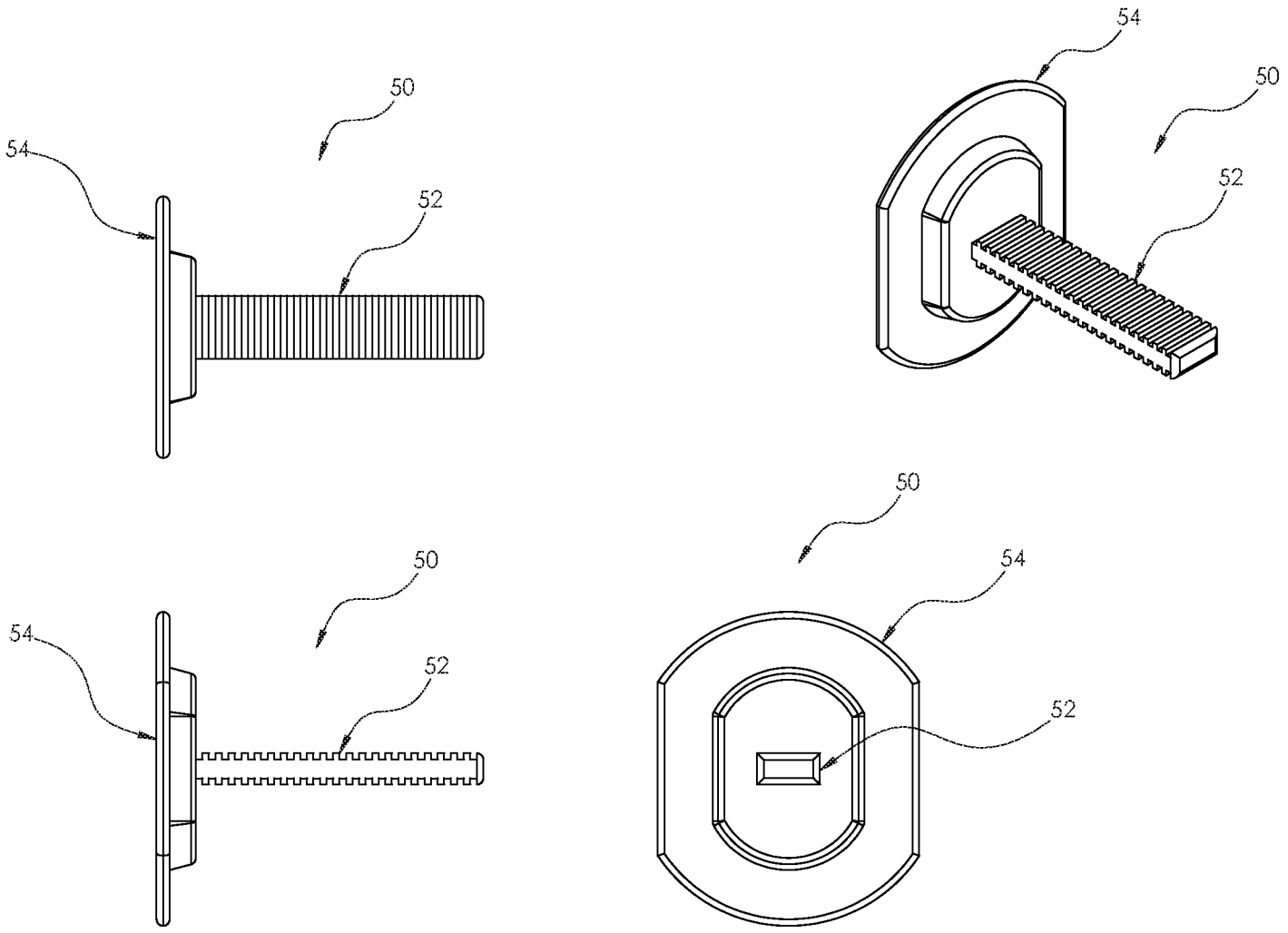
FIG. 9 illustrates alternate views of a male portion of the retention device.

FIG. 8 illustrates alternate views of the elongated engagement portion 60 apart from the retention device 40. The elongated engagement portion 60 includes a first end terminating in a plug 62 which is received and retained in the tubular body 44 by the receptacle formed by the recesses 76 and 78 (visible in FIGS. 6 and 7). Other connections between the first end and the tubular body 44 are possible. The elongated engagement portion 60 also includes an opposed second end terminating in a grip 80. The grip 80 is configured to be grasped by a finger or fingers. As seen in FIGS. 2, 3, and 4, the grip 80 extends from the tubular body 44 when installed.

Between the first end and the second end of the engagement portion 60 is a protrusion 82. When the male portion 50 is inserted in the tubular body 44 of the device, the protrusion 82 engages the teeth on the male portion 50 in order to engage and lock the male portion to the tubular body 44.

As best seen in FIGS. 5 and 8, the protrusion 82 comprises an angular tooth having a pair of sides which join together at a tip configured so that the tip engages the teeth on the male portion 50. The pair of sides join each other at an acute angle (see arrow 90 in FIG. 8). In a preferred embodiment, the sides join each other at an angle of between 25 and 35 degrees when engaged with the male portion 50.

The elongated engagement portion 60 is both flexible and resilient. The engagement portion 60 may be released from the inserted and locked position. Holding or gripping the grip 80 and exerting a withdrawal force on the elongated portion 60 will cause the angle between the sides to increase, thereby extending the length of the elongated portion 60, lowering the level or position of the tip of the protrusion 82, and releasing the male portion 50 from the engagement portion 60. The device may then be removed without any tools or other equipment.

The present invention accordingly provides a retention device that may be installed without any tools or other equipment and that may be removed without any tools after the door and casing have been transported and installed in the door opening.

Whereas, the present invention has been described in relation to the drawings attached hereto, it should be understood that other and further modifications, apart from those shown or suggested herein, may be made within the spirit and scope of this invention.

What is claimed is:

1. A pre-hung door and casing retention device, wherein said door has a door lock cylinder opening and a door latch opening and wherein said casing has a latch bolt opening, which retention device comprises:

a tubular body configured to be receivable in said door lock cylinder opening and said door latch opening;

a male portion having an extending post with a plurality of teeth extending from at least one side of said post, said male portion receivable in said latch bolt opening and said door latch opening;

an elongated engagement portion having a first end fastened in said tubular body, an opposed second end extending from said tubular body, and a protrusion between said first end and said second end, wherein said protrusion engages said teeth on said male portion in a locked position when said post of said male portion is inserted in said tubular portion and wherein said protrusion is disengaged from said teeth on said male portion when a withdrawal force is exerted on said engagement portion, wherein said elongated protrusion comprises an angular tooth having a pair of sides which join at a tip configured so that said tip engages said teeth on said male portion, and wherein said pair of sides of said angular tooth join each other at an angle between 25 and 35 degrees when in said locked position, and wherein said angle increases when said withdrawal force is exerted on said engagement portion.

2. The door and casing retention device as set forth in claim 1 wherein said tubular body has an arcuate end which mates with said door lock cylinder opening.

3. The door and casing retention device as set forth in claim 1 wherein said extending post of said male portion extends from a base larger than said latch bolt opening.

4. The door and casing retention device as set forth in claim 1 wherein said extending post of said male portion has a plurality of teeth extending from opposed sides of said post.

5. The door and casing retention device as set forth in claim 1 wherein said elongated protrusion is flexible and resilient and wherein a length of said elongated protrusion is adjustable.

6. The door and casing retention device as set forth in claim 1 wherein said second end of said elongated engagement portion terminates in a grip.

7. A method of latching and unlatching a pre-hung door and casing, wherein said door has a door lock cylinder opening and a door latch opening and wherein said casing has a latch bolt opening, which method comprises:

inserting a tubular body and an elongated engagement portion into said door lock cylinder opening and said door latch opening, wherein said elongated engagement portion includes a first end fastened in said tubular body, an opposed second end, and a protrusion between said first end and said second end;

inserting a male portion having an extending post with a plurality of teeth extending from at least one side of said post into said latch bolt opening and said door latch opening; and engaging said teeth on said male portion with said protrusion on said engagement portion to latch said pre-hung door and casing; and disengaging said teeth of said male portion with said protrusion by exerting a withdrawal force on said elongated engagement portion, wherein said protrusion comprises an angular tooth having a pair of sides which join at a tip configured so that said tip engages said teeth, wherein said pair of sides of said angular tooth join each other at an angle of between 25 and 35 degrees when in said latched position, and wherein said angle increases when said withdrawal force is exerted on said engagement portion.

8. The method of latching and unlatching a pre-hung door and casing as set forth in claim 7 wherein said tubular body has an arcuate end which mates with said door lock cylinder.

9. The method as set forth in claim 7 wherein said extending post of said male portion extends from a base larger than said latch bolt opening.

10. The method as set forth in claim 7 wherein said extending post of said male portion has a plurality of teeth extending from opposed sides of said post.

* * * * *